United States Patent [19]

Paradiso

[11] Patent Number: 4,974,131

[45] Date of Patent: Nov. 27, 1990

[54] MODULAR FLUORESCENT LIGHTING SYSTEM

[76] Inventor: Jerome J. Paradiso, 915 South Blvd., Alpha, N.J. 08865

[21] Appl. No.: 273,475

[22] Filed: Nov. 21, 1988

[51] Int. Cl.[5] ..... F21S 3/00

[52] U.S. Cl. ..... 362/217; 362/219

[58] Field of Search ..... 362/217, 219, 221, 225

*Primary Examiner*—Ira S. Lazarus

*Assistant Examiner*—Sue Hagarman

*Attorney, Agent, or Firm*—Horst M. Kasper

[57] ABSTRACT

A lighting system arrangement has a fluorescent tube having a base which can be locked into a socket at its end for electrical contact and a housing having a top rear section with the top rear section of the housing having a bracket-shaped section including a flat upper section adapted to allow attachment of the socket in a precise geometric position and having an elongated vertical section with the vertical section forming a hollow inner space inside for allowing a wire to be fed through and an opening for the inner hollow space for allowing to make electrical contact to a wire, and a cylindrical housing section immediately joining the elongated vertical section of the lighting housing, and an outward flange adjoining the cylindrical section and providing an abutment for a fluorescent light tube, wherein the hollow inner space passes from the modular lighting housing to the socket and ends such as to be suitable to provide contact to one respective pin of the fluorescent tube in a contact area.

8 Claims, 7 Drawing Sheets

FIG. 1
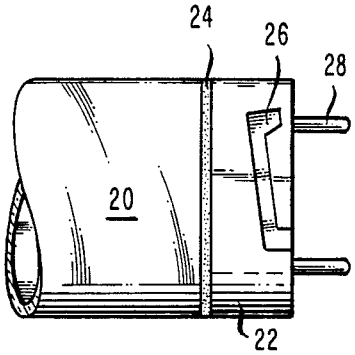
FIG. 2
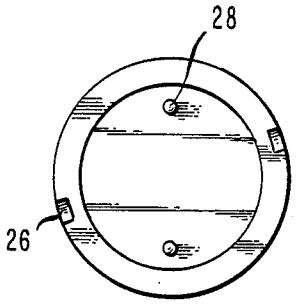
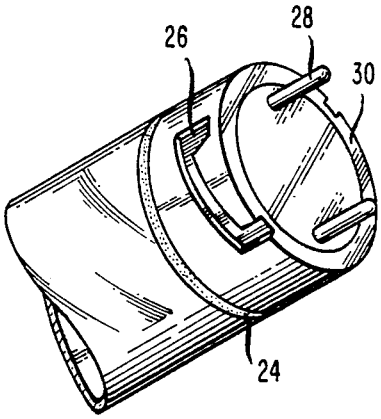
FIG. 3
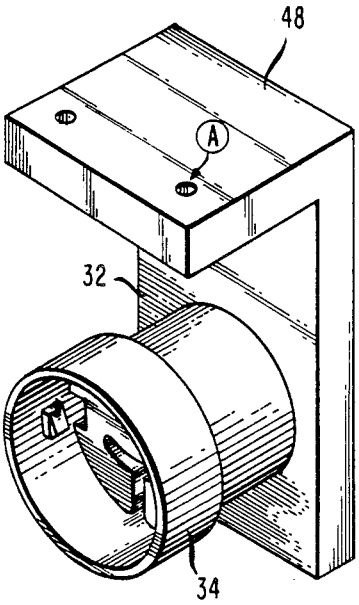
FIG. 4

FIG. 10
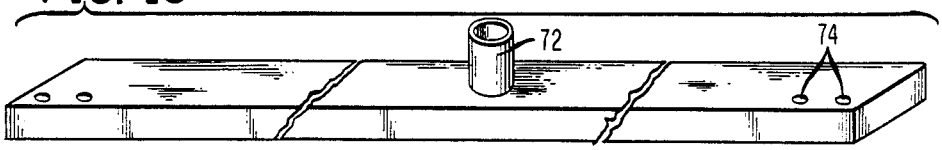
FIG. 11
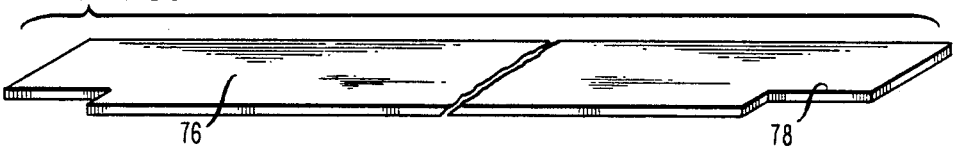
FIG. 12
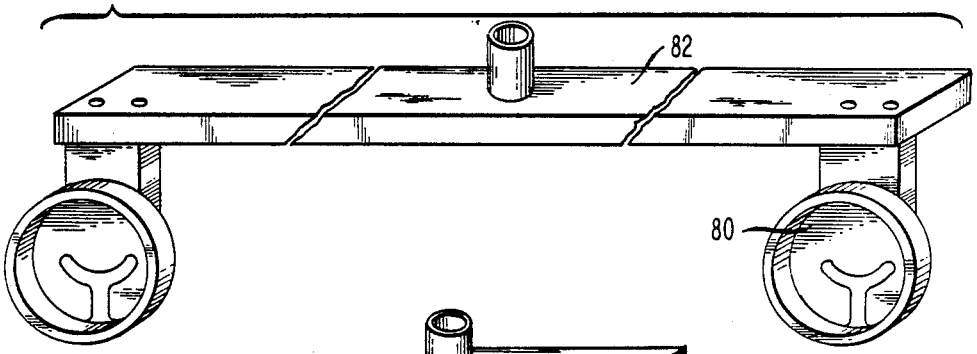
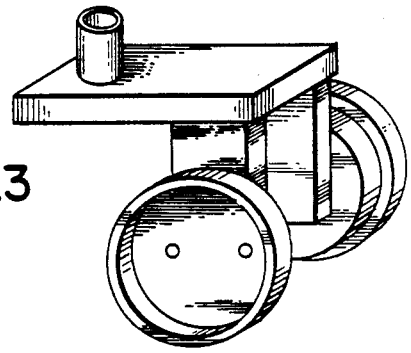
FIG. 13
FIG. 14
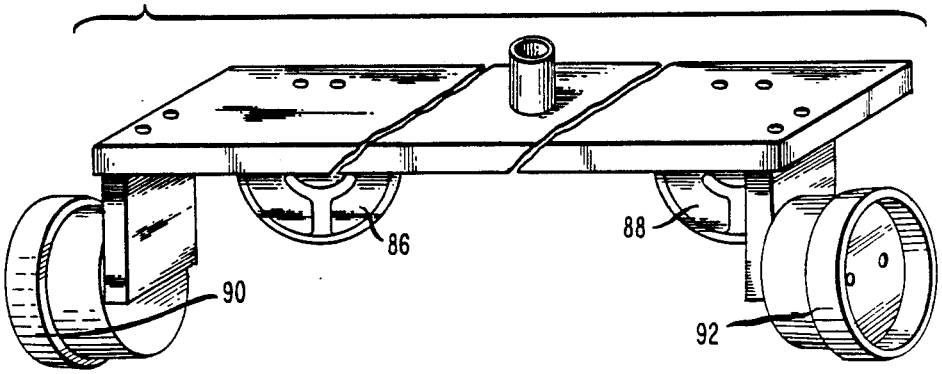

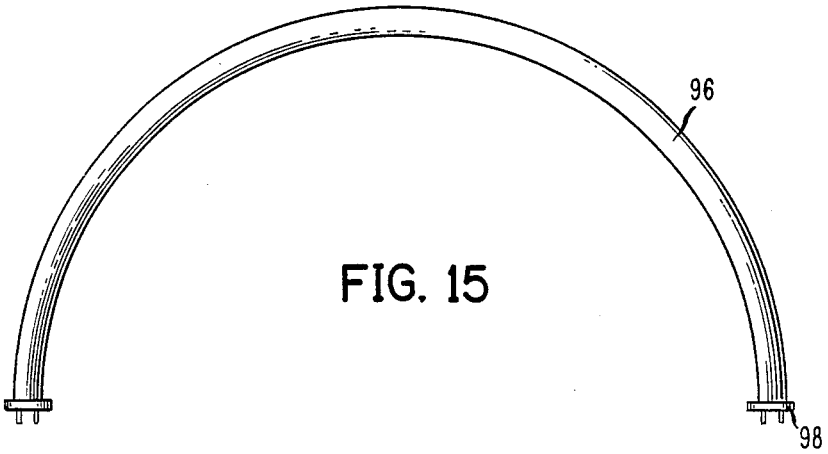
FIG. 15
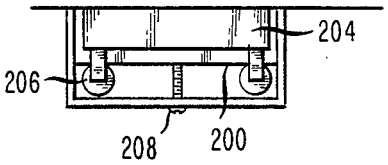
FIG. 16b
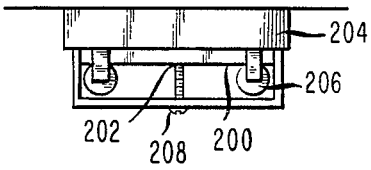
FIG. 16c
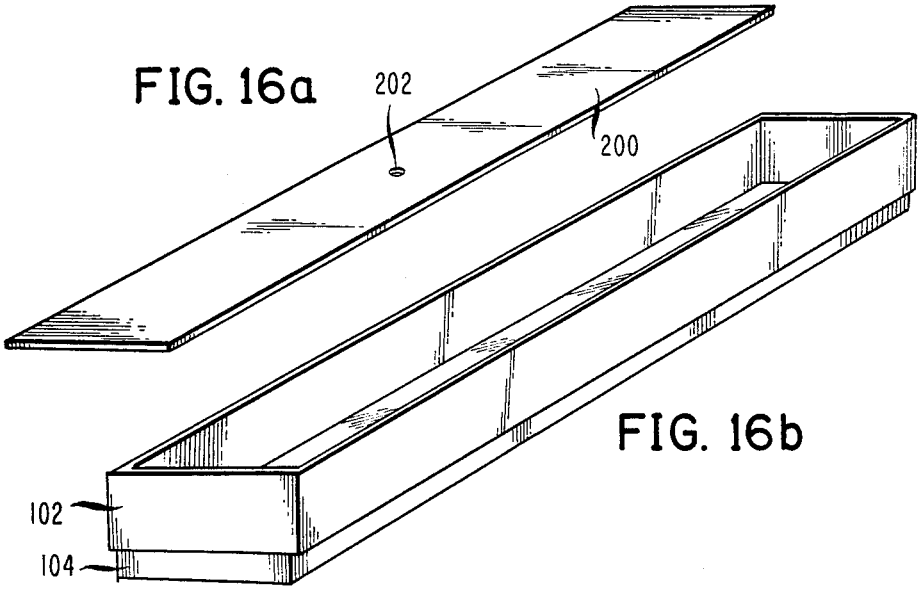
FIG. 16a
FIG. 16b FIG. 17
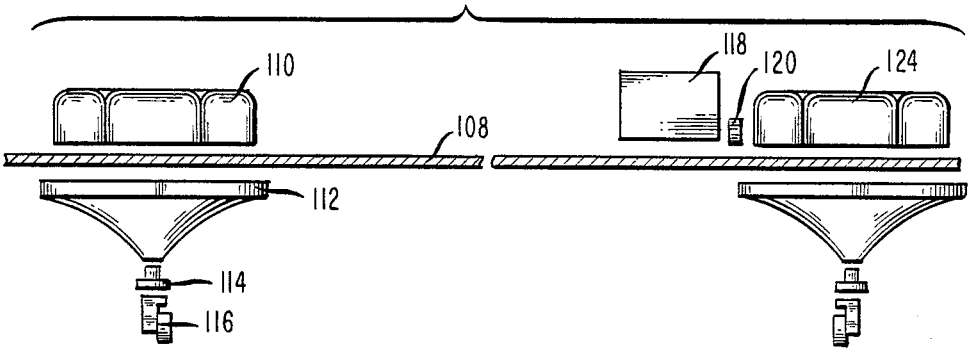
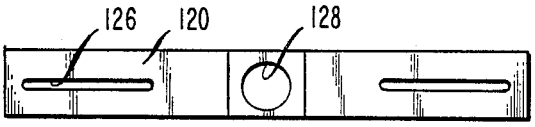
FIG. 18
FIG. 19
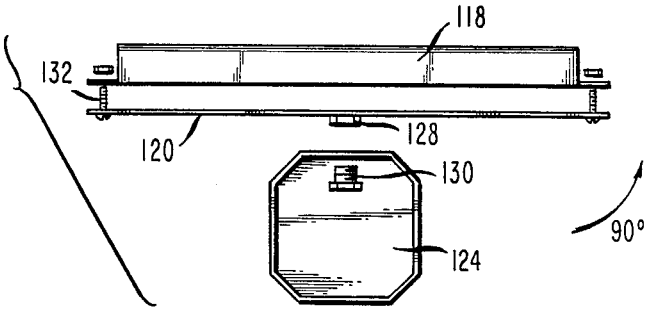
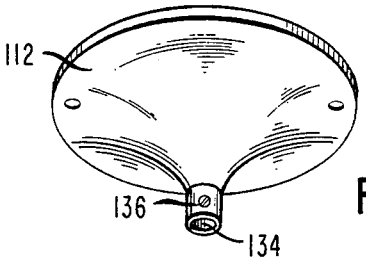
FIG. 20

FIG. 21
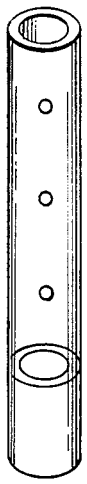
FIG. 22
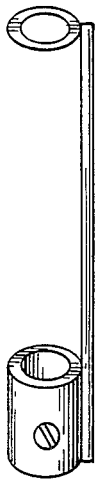
FIG. 23
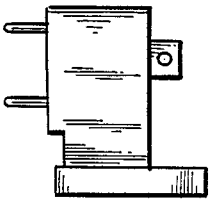
FIG. 24
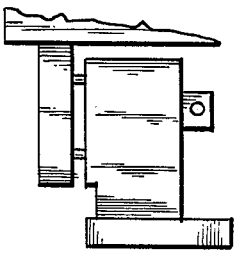
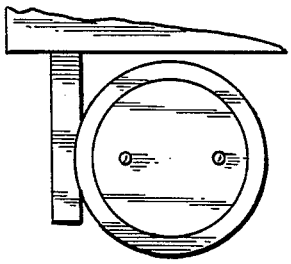
FIG. 25

MODULAR FLUORESCENT LIGHTING SYSTEM

BACKGROUND OF THE INVENTION

1. Field of the Invention

The invention relates to a lighting system based on fluorescent lamps.

2. Brief Description of the Background of the Invention Including Prior Art

Conventional fluorescent lighting systems are singular in design. A different fixture is required for each configuration of bulbs, usually 1, 2, 3, or 4 bulbs, and for each different length of bulb, usually 24", 30", 26", 40", or 48". The supplier of these fixtures must provide a large variety of different, complete fixtures. Also, conventional fixtures emphasize straight bulbs in parallel.

Conventional fluorescent lighting fixtures are directed to straight line systems employing straight bulbs in preconfigured arrangements like double parallel bulbs. Furthermore, most of these fixtures are suitable for commercial and factory environments but do not have the esthetic appeal required for home surroundings.

SUMMARY OF THE INVENTION

1. Purposes of the Invention

It is an object of the invention to provide modules to make a fluorescent lighting fixture that would be suitable for the various tube shapes, lengths, and configurations the user desires.

It is an object of the invention to provide modules to install fluorescent lighting of any desired pattern, using various tube shapes, sizes, and configurations without what is considered a fluorescent lighting fixture.

It is another object of this invention to provide bulb shapes, in compatible design, that enable the creation of an infinite variety of new patterns of fluorescent lighting.

It is an object of the present invention to provide a modular lighting system based on fluorescent bulbs, which can be adapted to various configurations.

It is another object of the present invention to provide modules which are suitable for forming various visual images out of preformed bulb components.

It is yet another object of the present invention to provide a system of support sockets, which is adapted to implement a modular fluorescent lighting system.

These and other objects and advantages of the present invention will become evident from the description which follows.

2. Brief Description of the Invention

According to the invention, there are provided sockets or housings which are adapted to support fluorescent light tubes. The sockets or housings comprise a hollow inside for allowing a power-connecting wire to be fed through. The support sockets or housings are provided at their ends with a locking sleeve to lock the fluorescent tubes into the socket.

The fluorescent tube has a grooved base that allows for locking the fluorescent tube into the socket. The fluorescent tube socket is a housing having a top rear section with the top rear section of the housing having a bracket-shaped section including a flat upper section adapted to allow attachment of the socket in a precise geometric position and having an elongated vertical section with the vertical section forming a hollow inner space inside for allowing a wire to be fed through and an opening for the inner hollow space for allowing to make electrical contact to a wire, and a cylindrical housing section immediately joining the elongated vertical section of the lighting housing, and an outward flange adjoining the cylindrical section and providing an abutment for a fluorescent lighting tube, wherein the hollow inner space passes from the modular lighting housing to the socket and ends such as to be suitable to provide contact to one respective pin of the fluorescent tube in a contact area. A locking sleeve is furnished for being locked at the housing by the flange. The locking sleeve comprises a counterflange for abutting the flange of the socket and a cylindrical sleeve section following the flange. The cylindrical sleeve section comprises locking protrusions for locking the fluorescent tube into position such that the top of the socket fits into the locking sleeve. A bared wire pushed into one end of the slot for electrical connection.

A fixture base box allows the insertion of the wires to provide electricity for the fixtures. A ballast power unit is incorporated into the fixture base. Wiring tubes are connected to the fixture base box for feeding of wire from the fixture base box into the wiring tube. An elbow disposed at a second end of the wiring tube which elbow is attached to the wiring tube. The elbow allows the electrical connections to pass through and a socket bar is connected to the elbow with a housing attached to the socket bar.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1 is a side view onto the end of a fluorescent tube useful in the context of the present invention, FIG. 2 is a schematic end view of the view of FIG. 1, FIG. 3 is a perspective view of the embodiment of FIG. 1, FIG. 4 is a perspective view onto a modular lighting housing and socket, FIG. 10 is a view of a top section of a socket bar, FIG. 11 is a perspective view of a bottom piece to enclose the socket bar of FIG. 10, FIG. 12 is a perspective view of the socket bar with sockets attached, FIG. 13 is a view of a specific configuration of two sockets, FIG. 14 is a perspective view on a specific configuration of four sockets, FIG. 15 is a top view onto a semi-circular fluorescent lighting tube, FIG. 16 is a perspective view of a fluorescent-fixture cover, FIG. 16*a* is a perspective view of a reflector insert, FIG. 16*b* is an end view of the installed cover surrounding the entire fixture, FIG. 16*c* is another end view of the installed cover surrounding only the sockets and fluorescent tubes, FIG. 17 is an elevational and in part sectional view of a fluorescent lighting system with ballasts and all wiring above the ceiling, out of sight, FIG. 18 is an elevational side view of a ballast strap adapted for attaching a ballast to a gem-box above a ceiling, FIG. 19 is an exploded top view of the right hand side of the embodiment of FIG. 17 illustrating the atttachment of ballast to gem box, FIG. 20 is a perspective view from below illustrating a circular base plate for supporting a fluorescent lamp with hidden ballast, FIG. 21 is a perspective front elevational view illustrating a socket bar stacker strap, FIG. 22 is a perspective side elevational view illustrating the socket bar stacker strap, FIG. 23 is a schematic elevational view illustrating a C-socket adapter, FIG. 24 is a schematic elevational view illustrating the C-socket adapter inserted into a socket, and FIG. 25 is a schematic elevational view from a side illustrating the C-socket adapter installed.

DESCRIPTION OF INVENTION AND PREFERRED EMBODIMENT

Figure 5:
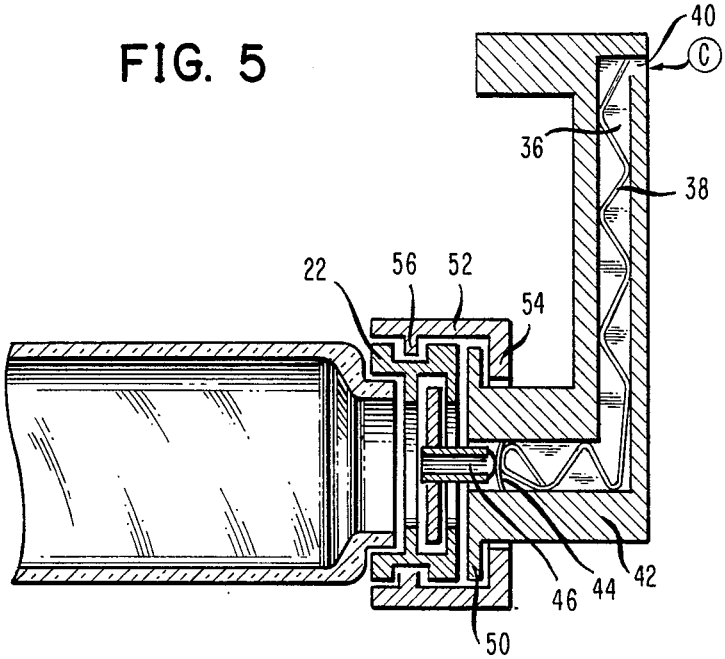
FIG. 5 is a sectional view through the modular lighting housing and socket together with an inserted fluorescent tube.

The lighting fixtures according to the present invention comprise an assortment of compatible parts. A lighting fixture employing these parts can be furnished by using a few of the parts from the total variety available.

The base of the fluorescent tube has a groove on each side. These grooves are located in the socket and there are tabs which are inside of the locking sleeve 56 of the tube socket 34. After the tube is inserted into the socket or housing, the tabs inside the locking sleeves are lined up with the grooves and the sleeve is pulled onto a tube flange. As the sleeve is turned clockwise, the tabs move in the grooves and are forced forward. When the end of the groove is reached, the tabs snap back to their original shape and the tube locked into the socket. A little force can be used to turn the sleeve in a counter-clockwise direction and this will unlock the tabs and allow removal of the sleeve and the tube.

The tube-locking socket will accept all kinds of fluorescent tubes and even tubes with no locking base.

The fixture base box is a rectangular-shaped box that is a base for the fixture and that holds the ballast inside. The top of the box has holes for the attachment to a standard gem-box. The front of the box is removable. Each end of the box has a short hollow tube or nipple attachment. Each nipple has a set screw on the side of it. These nipples can hold the wiring tubes. This box can be the same for all fixtures made and contemplated.

The wiring tube can be a rigid hollow tube that fits tightly into the nipple at the end of the fixture base box. At least two of these wiring tubes are needed, one on each side of the fixture base box. These tubes can be made in several different lengths as set forth below. The length of the wiring tube used is dependent on the length of the fluorescent tube being used. The user has to select the length which is dependent on the length of the fluorescent tubes.

A hollow rectangular housing, that can hold the fluorescent tube sockets of the fixture, can attach to the elbow. This hollow rectangular housing is an essential feature of the universal fixture system of the invention and of the fixtureless lighting system to be described. Two of these rectangular housings one on each end are required for each fixture and a large variety of these socket bars can be made available. The bar can be composed of two pieces, a top piece and a bottom piece. The bottom piece is in general just a flat piece that encloses the housing. The top of the socket bar housing can have a short hollow nipple that fits into the elbow for attachment to the fixture. In addition, holes for the screws that hold the sockets can be provided in the top. The bottom can be constructed elastically such as to snap into the top housing.

Sockets can be produced for various kinds of fluorescent tube bases. Two or more sockets are needed for any particular fixture.

It is preferred if the ballast is placed next to the open fixture base box. The wires can be taken from the ballast to the power source and can then be fed into the open box and through the large hole on top. The wires are taken from the ballast for connection to the sockets of one end of the fixture and they are then fed through one of the side holes. This can be repeated for the other side. A wiring tube, an elbow, and a socket bar can now be assembled. The wires coming from one side of the box can be fed through the assembled unit and can attach the unit to the box. The wires are then attached to the sockets and the sockets are attached to the bar, pulling any excess wire back into box. The bottom plate of the bar is then snapped on from below. This is also to be repeated for the other side. The ballast used is determined by the requirements of the fluorescent tube configuration of the fixture. The ballast initiation box is set according to the requirement of the bulb configuration to a predetermined value or values and the cover can be put on. This is essentially the fixture assembly.

It is advantageous in connection with the fixture constructions of the present invention that the ballast part of the fluorescent system can disappear out of sight.

Referring now to FIG. 1, there is shown a fluorescent lighting tube together with its bulb base. The fluorescent tube is designated with 20 and the bulb base section with 22. The bulb base junction section 24 sealingly connects the fluorescent tube to the bulb base. A groove 26 is provided in the bulb base to allow a locking insertion to lock the fluorescent tube in position.

The fluorescent tube as shown in FIG. 1, employs two socket pins 28 to provide electrical power to activate the gas in the fluorescent tube.

FIG. 2 is a view of an end of the fluorescent tube, where the electrical contact pin 28 as well as the grooves 26 can be recognized.

FIG. 3 is a perspective view of the end section. In particular, it can be recognized from FIG. 3 that there is a rim 30 provided around the tube and electrical power feed pins 28.

Referring to FIGS. 4 and 5, it can be recognized how the tube is locked onto the socket. The housing is constructed for use with the socket bar. The top of the socket fits into the socket bar and has two holes (A) for attachment using self-tapping screws. The top rear of the housing (C) has a wiring slot. A bared wire with a screwdriver is pushed into one end of the slot for electrical connection.

Referring now to FIG. 4, there is shown a perspective view of a modular lighting housing and socket. The housing comprises a bracket-shaped section which has a flat upper section 48 and an elongated vertical section 32.

As seen in FIG. 5, the vertical section is hollow inside at 36 and allows a wire 38 to be fed through. The lighting housing has an opening 40 for the inner hollow part 36 for allowing to make electrical contact to the wire 38. The cylindrical section, as recognized in FIG. 5, immediately joins the lighting housing. The hollow inner space passes from the modular lighting housing to the socket 42 and ends such as to be suitable to provide contact to a respective pin 46 of a fluorescent tube in a contact area 44. The socket housing has an upper section 48 which is adapted to allow attachment of the socket in a precise geometric position.

The socket section ends in an outward flange 50. This outward flange provides an abutment for a fluorescent lighting tube. A locking sleeve 52 is provided which is held such as to be locked at the lighting socket by the flange 50. The locking sleeve comprises a counterflange 54 which can abut the flange 50 of the socket. The locking sleeve comprises a cylindrical section following the flange 54 which cylindrical section comprises locking protrusions 56 for locking the part 22 of the fluorescent tube into position. The inner diameter of the locking sleeve is less than 10% and preferably less than 5% larger than the outer diameter of the fluorescent tube.

Figure 6:
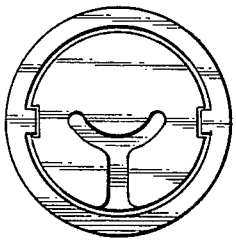
FIG. 6 is a schematic view of a recessed sleeve on a socket base.

FIG. 6 illustrates a recessed sleeve on a socket base. The grooves can be recognized and it can be seen that there are possibilities for providing a plug contact to the electrical pins of the fluorescent tube.

Figure 7:
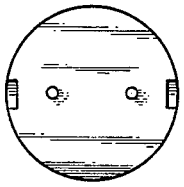
FIG. 7 is a view of the face of a socket for a fluorescent lighting tube.

FIG. 7 shows a face of a socket for a fluorescent tube. This embodiment is similar to that of FIG. 2.

Figure 8:
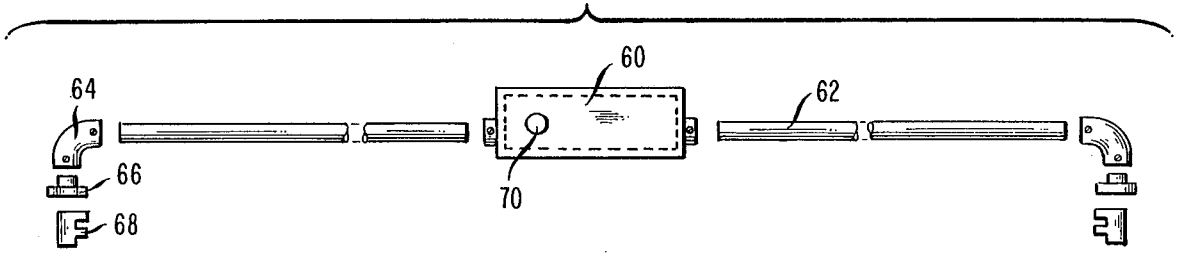
FIG. 8 is a side view onto an exploded system for supporting light fixtures.

FIG. 8 is an exploded side view of a system to be installed according to the invention. A fixture base box 60 is provided for allowing the insertion of the wires to provide electricity for the fixtures. Wiring tubes 62 are connected to the fixture base box 60 and allow the feeding of wire from the fixture base box into the wiring tube 62. At the other end of the wiring tube 62, there is provided an elbow 64 which is attached to the wiring tube and which allows the electrical connections to pass through. Following the elbow, there is an electric socket bar 66 followed by a socket 68. The power can be provided by a ballast power means illustrated at 70.

Figure 9:
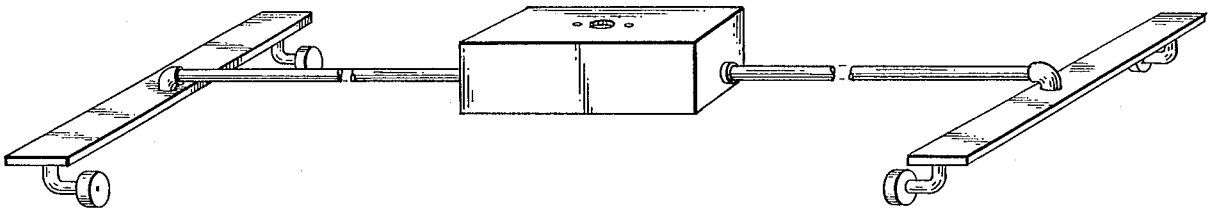
FIG. 9 is a view onto a system for supporting fluorescent lamps similar to that of FIG. 8.

The embodiment of FIG. 9 is an assembled embodiment. It resembles that of FIG. 8, however, the configuration of the sockets is different. This embodiment of FIG. 9 is capable of supporting two straight fluorescent tubes by itself.

The illustrations of FIGS. 10 to 12 refer to providing a fixture for two straight fluorescent tubes.

FIG. 10 is a top view of a socket bar which is adapted to provide a transit passage to the electrical wires and their current. A nipple 72 is provided for feeding in the electric power. Holes 74 are provided to allow screwing on of fluorescent lamp sockets.

FIG. 11 illustrates a bottom plate 76 to cover the top piece of the fixture. Cutouts for the sockets are provided at 78, according to FIG. 11.

FIG. 12 illustrates a fully assembled socket bar with sockets attached. Comparing FIG. 12 with FIG. 9, one recognizes the similarity of the configuration of the sockets 80 relative to the socket bar 82.

FIG. 13 is a view of another configuration of sockets attached to a socket bar. In FIG. 13 there is illustrated a socket bar for a fixture that uses two fluorescent tubes which form a circle of light. In this construction, two sockets are disposed along a single axis and adapted to receive from two opposite sides fluorescent tubes to be attached.

FIG. 14 is yet another view of a fixture according to the invention. There are shown four sockets for fluorescent bulb. FIG. 14 illustrates a socket bar for a fixture that uses four fluorescent tubes, of which two are straight and two are of the C-type or semi-circular type. In this case, the sockets are disposed such that two end sockets, disposed at the ends of the socket bar are such as to be opposite to each other each directed outwardly. Two sockets are disposed in parallel on a longitudinal side of the socket bar. Two of these socket bars can be employed together with two straight tubes for the sockets 86 and 88 and with two semi-circular tubes for the sockets 90 and 92. The sockets are disposed such that, together with a second unit two sockets 86 and 88 are suitable to match a second socket bar of the same kind to allow placement of two sockets between these two socket bars. Furthermore, there are two additional connection possibilities 90 and 92 which could be used to mount and to furnish sockets for semi-circular fluorescent lighting bulbs.

FIG. 15 illustrates, by way of example, a semi-circular fluorescent tube. In the context of the present invention, in particular circle sections, such as a half-circle, a quarter-circle, a sixth-circle, are to be used to allow construction of a variety of patterns to provide a figure-like fluorescent illumination. FIG. 15 illustrates at 96 a fluorescent tube which can be employed. Such fluorescent tubes can have an outside diameter of 24, 30, 36, 42, or 48 inches. The embodiment in FIG. 15 shows at 96 a semi-circle of a fluorescent bulb together with a bulb base 98 at its ends.

A decorative fluorescent-fixture cover according to FIG. 16 can enclose the entire fluorescent fixture and tubes. This cover can be a rectangular-shaped box with four sides and a translucent bottom. A lower part 104 of the rectangular casing can be recessed versus the upper part 102. In the center of the translucent bottom, there is provided a hole through which a support machine screw can be inserted.

FIG. **16*a* shows a separate rectangular flat insert 200, reflecting the light downwardly. The insert 200 is provided in its center with a threaded hole 202**. The width of said insert is about 0.5 mm narrower than the width of the cover and the length of this insert is about 3 mm less than the length of the fluorescent tubes used in the fixture.

After the fluorescent fixture 204 is installed, the reflector insert 200 is laid on top of the fluorescent tubes 206 and the cover is put around the fixture 204, as can be seen in FIGS. **16*b* and 16*c*. A support machine screw 208 is inserted through the outside bottom of the cover and screwed into the threaded hole 202 in the center of the reflector insert 200**.

The cover can surround the entire fixture as shown in FIG. **16*b*, or the cover can merely surround the fluorescent tubes and sockets, as shown in FIG. 16*c***.

There is further provided an assortment of compatible parts which enables a designer, installer, electrician or user of a fluorescent lighting system to have fluorescent lighting on a ceiling without visible fixtures. All of the wiring would be placed above the ceiling in accordance with this construction. This system furnishes the freedom to create an unlimited new and beautiful variety of patterns of fluorescent lighting. This system is eminently adapted to dropped ceilings, to grid ceilings, and to large face area ceilings as employed in commercial and industrial buildings and enterprises.

The component parts of this new system essentially include a ballast 118 connecting with a ballast strap 120 to the gem box 124, 110. To said gem box 124, 110 there can be connected a base plate 112, 112*a*, which can support the socket bar 114, 114*a*, and the socket 116, 116*a*. Said socket 116, 116*a* and/or socket bar 114, 114*a* can have any configuration, for example as illustrated in FIGS. 4–7 and 10–14.

An elevational and in part sectional view of a fluorescent lighting system with hidden ballasts is shown in FIG. 17. A gem box 110 serves to allow a safe furnishing of necessary electrical connections. A base plate 112 is attached from below to the gem box 110 in a ceiling 108. A socket bar 114 is used to provide a connection. The socket 116, 116*a* then is attached to the socket bar 114, 114*a*, and the fluorescent tube can be mounted between said sockets 116, 116*a*. A ballast box 118 is attached via a ballast strap 120 to the gem box 124.

A metal strap illustrated in FIG. 18 is used to attach the ballast in the ballast 118 to the gem 124 box above the ceiling 108. This strap 120 attaches to the ballast with two small nuts and screws 132 through the slots 126 of the strap 120. The ballast 118 with the strap 120 are then attached to the side of the gem box 124 with a hollow bolt 130 that screws into the nut 128 that is part of the ballast strap 120 as seen in FIG. 19 with an exploded top view of the right hand side of the embodiment of FIG. 17.

A circular base plate 112 forms a base for the fixture and is shown separately in FIG. 20 in a perspective view from below illustrating a circular base plate for supporting a fluorescent lamp socket with hidden ballast. There are two holes for attachment of the base plate 112 to the gem box 124. A short round nipple with a set screw mounted on the side of the nipple 134 protrudes downwardly in the center of the base plate 112. The socket bar 114 is placed into this nipple and the set screw 136 is then tightened.

Additionally a socket bar nipple extension can be provided which allows to place the fixture at different desired distances from the base plate 112. The socket bar nipple extension is a hollow round tube that serves to make the nipple on top of the socket bar longer. This allows the user to have an overlapping of tubes and tubes going in two different directions.

A socket bar stacker strap enables a user to stack socket bars, one below the other as illustrated in FIG. 21 and 22. The top of the strap fits over the nipple of the socket bar. The bottom socket bar fits into the nipple at the bottom of the strap. This allows it to stack the tubes with overlapping of tubes and with tubes going into different directions.

An conversion adapter also called C-tube adapter can be employed for conversion of the standard two pin socket for straight tubes to a socket for C-tubes as illustrated in FIGS. 23 to 25. This conversion adapter is placed into a socket, turned one quarter turn in clockwise direction and made rigid with a tightening a self tapping screw to the fixture.

It will be understood that each of the elements described above, or two or more together, may also find a useful application in other types of lighting system configurations differing from the types described above.

While the invention has been illustrated and described as embodied in the context of a modular fluorescent lighting system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A lighting system arrangement comprising a fluorescent tube having a base which can be locked into a socket at its end for electrical contact;

a housing having a top rear section with the top rear section of the housing having a bracket-shaped section including a flat upper section adapted to allow attachment of the socket in a precise geometric position and having an elongated vertical section with the vertical section forming a hollow inner space inside for allowing a wire to be fed through and an opening for the inner hollow part for allowing to make electrical contact to a wire, and a cylindrical housing section immediately joining the elongated vertical section of the lighting housing, and an outward flange adjoining the cylindrical section and providing an abutment for a fluorescent lighting tube, wherein the hollow inner space passes from the modular lighting housing to the socket and ends such as to be suitable to provide contact to one respective pin of the fluorescent tube in a contact area;

a locking sleeve for being locked at the housing by the flange wherein the locking sleeve comprises a counterflange for abutting the flange of the socket and a cylindrical sleeve section following the flange which cylindrical sleeve section comprises locking protrusions for locking the fluorescent tube into position such that the top of the socket fits into the locking sleeve; a bared wire pushed into one end of the slot for electrical connection.

2. The lighting system arrangement according to claim 1 wherein an inner diameter of the locking sleeve is less than 10% larger than the outer diameter of the fluorescent tube.

3. The lighting system arrangement according to claim 1 wherein the base of the fluorescent lamp is provided with a groove to allow a locking insertion to lock the fluorescent tube in position.

4. The lighting system arrangement according to claim 1 further comprising a rim disposed around the tube and electrical power feed pins.

5. The lighting system arrangement according to claim 1 where the cylindrical section contains a recessed sleeve including grooves for providing a plug contact to the electrical pins of the fluorescent tube.

6. The lighting system according to claim 1 further comprising a gem box for electrical connections;

a base plate attachable from below to a ceiling;

a socket bar connectable to the base plate;

a socket attached to the socket bar for mounting of a fluorescent tube.

7. The lighting system according to claim 6 further comprising a ballast strap attached to a gem box;

a ballast box attached to the ballast strap and thereby to the gem box.

8. A fluorescent-fixture cover surrounding or enclosing the lighting fixture according to claim 1 comprises a decorative cover which can be connected to the modular fluorescent lighting fixture and an insert reflecting the light downwardly and holding the cover in place.

* * * * *